US005492450A

United States Patent [19]

Bearint et al.

[11] Patent Number: 5,492,450

[45] Date of Patent: Feb. 20, 1996

[54] CONTROL VALVE FOR VARIABLE CAPACITY VANE COMPRESSOR

[75] Inventors: David E. Bearint; James I. Miller, both of Decature, Ill.

[73] Assignee: Zexel USA Corporation, Decature, Ill.

[21] Appl. No.: 127,194

[22] Filed: Sep. 27, 1993

[51] Int. Cl.[6] ..... F04B 49/02

[52] U.S. Cl. ..... 417/295; 417/310

[58] Field of Search ..... 417/295, 309, 417/310, 440

[56] References Cited

U.S. PATENT DOCUMENTS

| | | |
|---|---|---|
| 4,838,740 | 6/1989 | Watanabe et al. . |
| 4,842,490 | 6/1989 | Watanabe et al. . |
| 4,844,703 | 7/1989 | Watanabe et al. . |
| 4,881,878 | 11/1989 | Kobayashi et al. . |
| 5,020,975 | 6/1991 | Aihara . |
| 5,030,066 | 7/1991 | Aihara et al. . |
| 5,145,327 | 9/1992 | Nakajima et al. . |
| 5,364,235 | 11/1994 | Bearint ..... 417/295 |

*Primary Examiner*—Richard A. Bertsch
*Assistant Examiner*—William Wicker
*Attorney, Agent, or Firm*—James E. Bradley

[57] ABSTRACT

A control valve for a variable rotary vane compressor is modular. The control operates an actuator to vary the position of a rotary valve plate located between the intake chamber and the compression chamber. The control valve locates in a cavity which has a suction pressure portion, a control pressure portion, and a discharge pressure portion. The control valve has an end cap and a valve seat member connected together by a sleeve. A valve element engages a seat in the valve seat member. The spring and a bias pin urge the valve element to the closed position. A bellows located within the sleeve has a stem that contacts the valve element to move it off of the seat. The sleeve allows the distance between the valve seat member and the end cap to be varied to preset the bellows prior to installation in the compressor.

19 Claims, 4 Drawing Sheets

CONTROL VALVE FOR VARIABLE CAPACITY VANE COMPRESSOR

BACKGROUND OF THE INVENTION

1. Field of the Invention

This invention relates in general to variable capacity rotary vane compressors for air conditioning systems, particularly for vehicles, and in particular to improvements in a control valve for that type of compressor.

2. Description of the Prior Art

One type of automotive air conditioning compressor in use is a variable capacity vane compressor. In this type of compressor, a compression housing has a chamber that is oval in shape. A cylindrical rotor extends through the chamber. The rotor has radial vanes mounted to it which slide radially in slots formed in the rotor. Refrigerant at suction pressure enters the compression chamber, with the vanes compressing the refrigerant, which passes outward through a valve.

The compressor demand varies according to speed and atmosphere conditions. At highway speed, the demand is usually lower than while idling on a hot day. To vary the capacity, a rotary valve disk or plate mounts in front of the compression housing and in engagement with a shoulder on the compression housing. The valve plate has a slotted perimeter which will change the position of the opening from the intake chamber into the compression chamber depending upon the rotational position of the valve plate. The valve plate is rotatably carried in a rotary valve housing, also known as a rear side block. The particular rotational position of the valve plate will change the quantity of refrigerant introduced between the vanes for compression by changing the timing of the compression cycle.

An actuator will rotate the valve plate to selected positions depending upon the changes in the discharge pressure and the intake or suction pressure. In one type, such as shown in U.S. Pat. No. 5,145,327, the actuator member comprises radial projections mounted to the rear side of the rotary valve plate and located within chambers. Each projection serves as a piston. Variable fluid pressure is applied to both sides of each piston. Also, a spring will urge the plate to a minimum delivery position.

In another type of actuator, the rotary valve plate is rotated by a spool piston, such as shown in U.S. Pat. No. 4,838,740. The spool piston moves linearly transverse to the axis of the rotor. The spool piston has a pivot pin that engages the plate to cause it to rotate as the spool piston moves.

A control valve applies pressure to the actuator for controlling the position of the rotary valve plate in response to intake and discharge pressures. In one type, the control valve supplies a control pressure to one side of the actuator piston, the other side of the actuator piston being at intake pressure. The control valve includes a bellows which has a stem that engages a ball valve. The bellows is located in a portion of the suction chamber. A plunger or bias pin on the opposite side of the ball has one end exposed to discharge pressure. The bias pin and the stem of the bellows cooperate depending upon the discharge and intake pressure to vary the control pressure at one side of the actuator for moving the rotary valve plate.

Normally, the suction pressure set point for the bellows must be adjusted for each control valve during assembly. The suction pressure set point is the point at which the suction pressure is sufficiently low relative to the discharge pressure to cause the stem of the bellows to move the ball off of the seat. In one type of compressor being manufactured, this is handled by installing the components of the control valve in the compressor, completing the assembly of the compressor, and operating the compressor with nitrogen. The operator monitors pressures and adjusts the suction pressure set point with an adjustment screw that contacts one end of the bellows. This procedure is time consuming and expensive.

SUMMARY OF THE INVENTION

In this invention, the control valve which supplies a control pressure to the actuator to cause it to move to rotate the valve plate is modular. The control valve locates within a cavity in the housing. The cavity has a suction pressure portion, a discharge pressure portion and a control pressure portion. The modular control valve has an end cap on one end and a valve seat member on the other end. The valve seat member and the end cap are connected together by a sleeve which encloses the bellows.

The valve seat member has a valve element which is urged by a ball into engagement with the seat. A bias pin is movably carried in a discharge pressure port in the valve seat member for engaging the valve element. The valve seat member has a control pressure port which leads from the valve seat to the control pressure portion of the cavity. The valve seat member has an orifice leading from the discharge portion of the cavity to the control portion of the cavity.

Preferably, the sleeve connects the end cap to the valve seat member such that end cap and valve seat member may be adjusted to variable axial distances apart from each other. The modular control assembly can be placed in a test fixture prior to insertion into the cavity. The operator will apply and monitor test pressures and adjust the distance between the end cap and the valve seat member. Once adjusted, the modular control valve assembly can be inserted into the compressor.

DETAILED DESCRIPTION OF THE INVENTION

Figure 1:
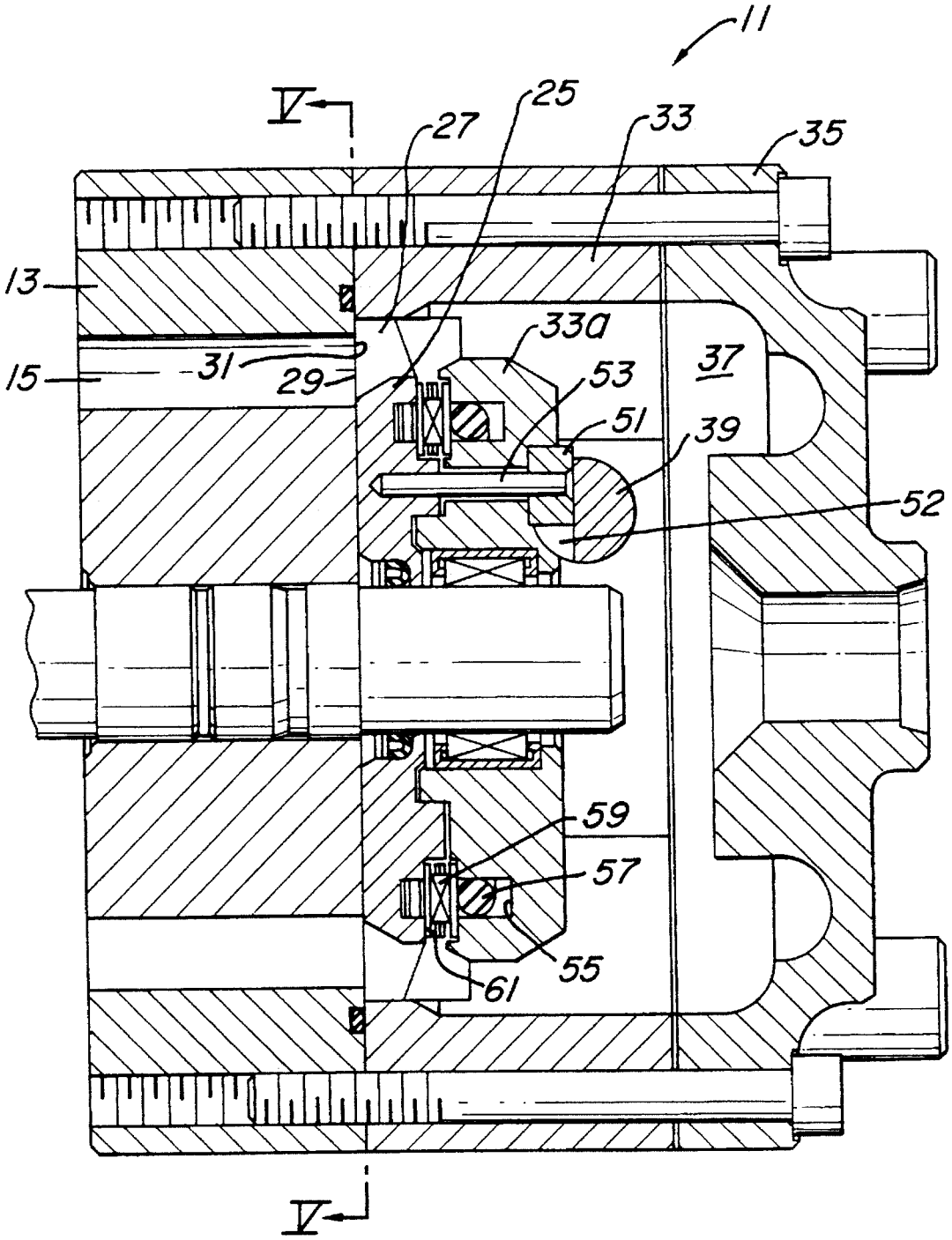
FIG. 1 is a partial sectional view illustrating a compressor constructed in accordance with this invention.
Figure 5:
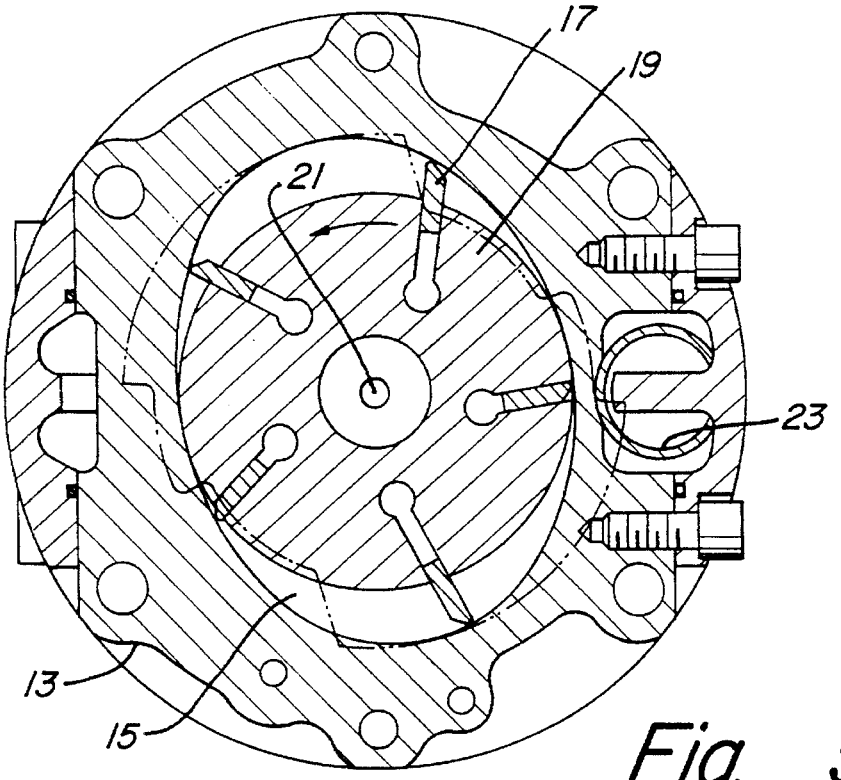
FIG. 5 is a sectional view of the compressor of FIG. 1, taken along the line V—V of FIG. 1.

Referring to FIG. 1, compressor 11 is shown partly in a sectional view. Compressor 11 is a variable capacity vane type compressor. It includes a compressor housing 13 which has compression chamber 15. As shown in FIG. 5, compression chamber 15 is generally oval in configuration. A plurality of vanes 17 mounted in slots on a rotor 19 rotate inside compression chamber 15. Rotor 19 rotates on an axis 21 that is concentric with compression chamber 15. Valves 23 (only one shown) provide for the discharge of refrigerant gas from the compression chamber 15. The refrigerant gas passes to a discharge chamber, which is not shown, but which is the type as shown in U.S. Pat. No. 5,145,327, Nakajima, et al, Sep. 8, 1992, all of which material is hereby incorporated by reference.

Figure 6:
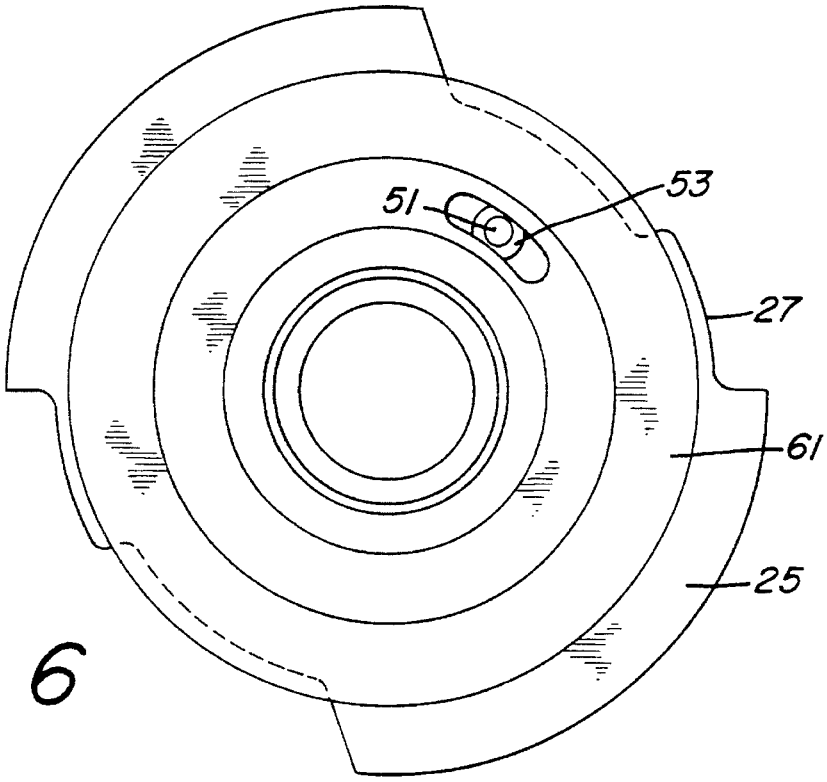
FIG. 6 is a rear elevational view of the rotary valve plate used with the compressor of FIG. 1.

Referring again to FIG. 1, a rotary valve plate 25 mounts rotationally to the intake side of compressor chamber 15. Rotary valve plate 25 is a disk-shaped member, having an irregular perimeter 27 as shown in FIG. 6, which defines slots. As shown in FIG. 5, the particular rotational position of rotary valve plate 25 will change the position of the intake opening into the compression chamber 15 and thus the volume of refrigerant introduced between the vanes 17 as rotor 19 rotates. In this manner, the capacity of compressor 11 can be varied.

Referring again to FIG. 1, rotary valve plate 25 has a face 29 on the forward side that slidingly engages a compression housing shoulder 31. The compression housing shoulder 31 surrounds compression chamber 15. The contact is metal-to-metal between rotary valve face and compression housing shoulder 31.

Rotary valve plate 25 will rotate approximately 70 degrees from a fully closed position to a fully open position. Rotary valve plate 25 is carried in a rotary valve housing 33, also called a rear side block. Rotary valve housing 33 mounts stationarily to compression housing 13 and has a central portion 33*a*. A rear head 35 mounts to the rear of rotary valve housing 33 by bolts. An intake chamber 37 is defined within rear head 35 and surrounds the central portion 33*a* of rotary valve housing 33. Intake chamber 37 will be at the suction or intake pressure of the refrigerant after it has passed through the evaporator (not shown).

Figure 2:
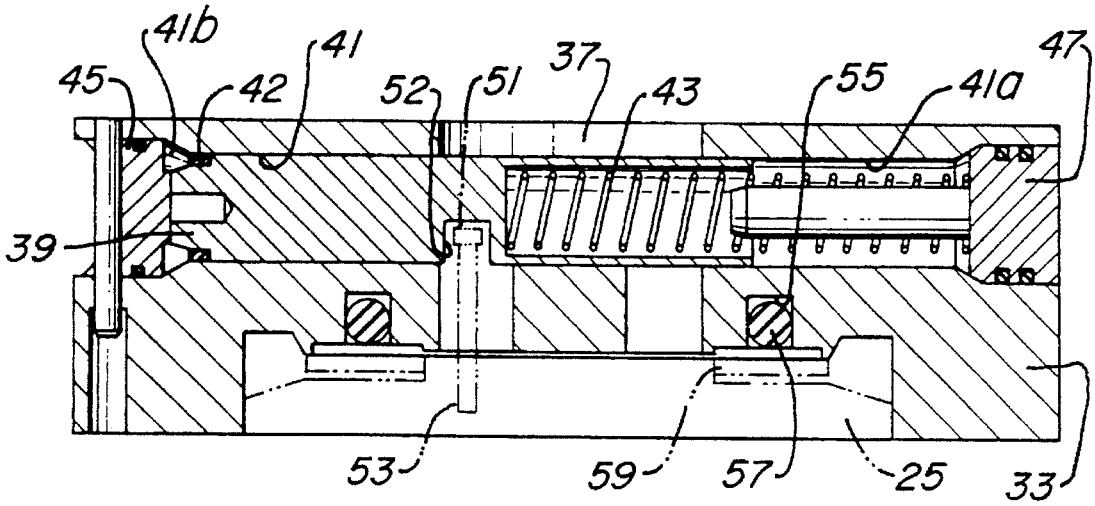
FIG. 2 is another sectional view of the compressor of FIG. 1, taken along a section line that is perpendicular to the section shown in FIG. 1.

An actuator member or piston 39 will rotate rotary valve housing 33 between the minimum and maximum positions. Actuator piston 39 is a spool-type piston, located transverse to the axis 21 of rotor 19. As shown in FIG. 2, actuator piston 39 is located in a piston chamber 41 which extends transversely through rotary valve housing 33. The central portion of piston chamber 41 is intersected by a portion of intake chamber 37, thus resulting in two separate sections. Actuator piston 39 has a seal 42 which defines in chamber 41 a suction side 41*a*, which is on the right side of seal 42, and a control pressure side 41*b*, which is on the left side of seal 42. Control pressure side 41*b* is supplied with a control pressure for moving actuator piston 39 to the right in response to change in demand on compressor 11. A coil spring 43 urges actuator piston 39 to the left, which positions rotary valve plate 25 in the minimum capacity position. End caps 45, 47 seal the opposite ends of piston chamber 41. A suction passage (not shown) leads from the suction side 41*a* to intake chamber 37 to assure that suction pressure is communicated to the suction side 41*a* of piston chamber 41.

Figure 3:
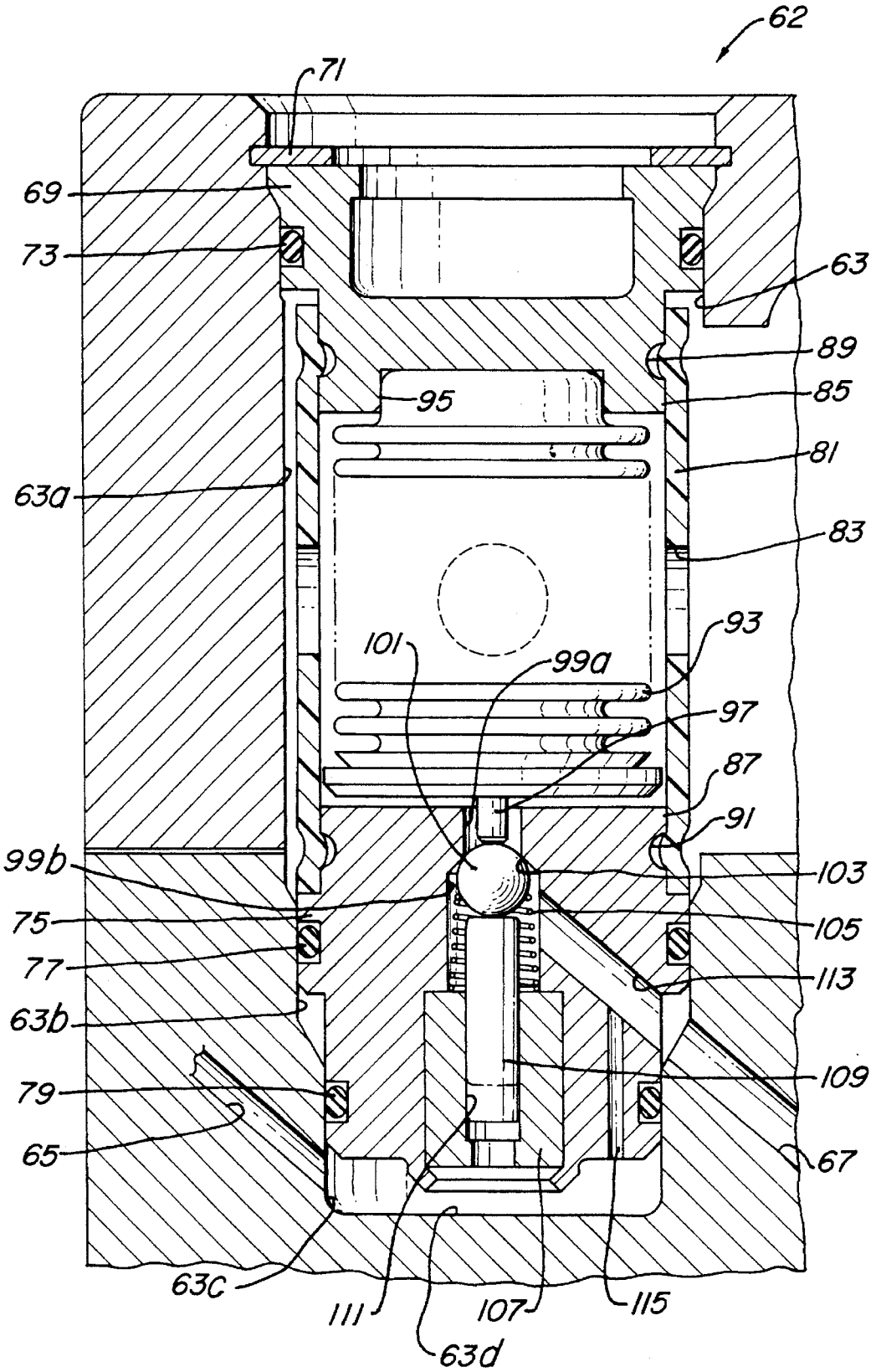
FIG. 3 is a sectional view of a control valve for the compressor of FIG. 1.

Referring to FIGS. 1 and 3, the linkage means between actuator piston 39 and rotary valve plate 25 includes in the preferred embodiment a roller 51, which is a small, rotatable member locating within an undercut 52 in actuator piston 39. Roller 51 is rotatably mounted to a pin boss 53, which is rigidly mounted to rotary valve plate 25. Linear movement of actuator piston 39 causes rotational movement of rotary valve plate 25 through roller 51 and pin boss 53.

Referring again to FIG. 1, axial piston means exist for applying a variable axial force on rotary valve plate 25 to enhance sealing between rotary valve face 29 and compression housing shoulder 31. The axial piston means includes an annular axial pressure chamber 55 that is located in central portion 33*a* of rotary valve housing 33. Axial pressure chamber 55 is a groove concentric to rotor axis 21. Axial pressure chamber 55 is rectangular in transverse cross section. Control pressure will be supplied to axial pressure chamber 55, as will be explained subsequently.

The axial piston means also includes a seal member or seal ring 57, which is sealingly located in axial pressure chamber 55. Seal ring 57 is a conventional O-ring, circular in transverse cross section. Seal ring 57 will have its rearward side exposed to control pressure in axial pressure chamber 55. An annular bearing 59 is located on a shoulder 61 on rotary valve plate 25. Bearing 59 is a conventional thrust bearing which has one side engaged by seal ring 57 and the other side in contact with shoulder 61. In the preferred embodiment, bearing 59 is a needle-type thrust bearing, with needles located between forward and rearward plates. The forward plate, which is in contact with shoulder 61, will rotate with rotary valve plate 25, while the rearward plate of bearing 59 will remain in stationary engagement with seal ring 57. Seal ring 57 can move axially within axial pressure chamber 55 to exert a variable axial force on bearing 59 to increase and decrease the force of rotary valve face 29 on compression housing shoulder 31.

A control valve 62 for supplying control pressure to actuator piston 39 and to axial pressure chamber 55 is shown in FIG. 3. Control valve 62 does not appear in FIG. 1 because of the different sectional view shown in FIG. 1. Control valve 62 is a modular assembly that inserts into a cavity 63. Cavity 63 may be partially in the rotary valve housing 33 and partially in rear head 35, as shown, or all of it may be located within the rotary valve housing 33. Cavity 63 is located on an axis that is parallel to the rotor axis 21 (FIG. 5) and is cylindrical.

Cavity 63 has a suction pressure portion 63*a*, a control pressure portion 63*b*, a discharge pressure portion 63*c*, and a base 63*d*. In the embodiment shown, the suction pressure portion 63*a* extends partially through the suction chamber 37 and is wholly located within the rear head 35. The control pressure portion 63*b* and discharge pressure portion 63*c* are located within rotary valve housing 33 in the embodiment shown. Also, in FIG. 3, the diameter of suction pressure portion 63*a* is greater than the diameter of control portion 63*b*, which in turn is greater than the diameter of discharge portion 63*c*.

A discharge pressure passage 65 extends to the discharge pressure portion 63*c*. Discharge pressure passage 65 communicates discharge pressure from the discharge chamber (not shown) to discharge pressure portion 63*c*. A control pressure passage 67 extends through rotary valve housing 33 to piston chamber portion 41*b* (FIG. 2) for supplying a control pressure to move actuator piston 39. Control pressure passage 67 also extends to axial pressure chamber 55 for supplying the same control pressure to seal ring 57 (FIG. 2).

Control valve 62 has an end cap 69 which locates in suction pressure portion 63*a*. End cap 69 is a closed member secured rigidly within cavity suction pressure portion 63*a* by a retaining ring 71. A seal 73, shown to be an O-ring, seals end cap 69 within cavity suction pressure portion 63*a*.

Control valve 62 also has a valve seat member 75. Valve seat member 75 has a larger diameter portion that locates within cavity control pressure portion 63*b*. A seal 77 seals this portion of valve seat member 75 to cavity control pressure portion 63*b*. Valve seat member 75 also has a smaller diameter portion that extends into cavity discharge portion 63*c*. A seal 79 seals the smaller diameter portion of valve seat member 75 to cavity discharge pressure portion 63*c*. Valve seat member 75 has an end that is spaced from the base 63*d* of cavity 63 by a variable gap. The gap allows valve seat member 75 to be moved to various axial positions in cavity portions 63*b* and 63*c* relative to end cap 69.

Connection means connects end cap 69 to valve seat member 75 at adjustable axial distances relative to each other. The connection means of FIG. 3 includes a sleeve 81 that is of metal and is cylindrical. Sleeve 81 has suction ports 83 in its sidewall for communicating the interior of sleeve 81 with suction chamber 37. End cap 69 has a reduced diameter neck 85 that extends into cavity 63. Valve seat member 75 has a reduced diameter neck 87 that extends toward end cap neck 85. Sleeve 81 secures to necks 85, 87 by slidingly inserting over necks 85, 87.

End cap neck 85 has an annular groove 89. Similarly, valve seat neck 87 has an annular groove 91. Sleeve 81 is of a sheet metal that allows it to be permanently deflected, as indicated, into the grooves 89, 91. This deflection into grooves 89, 91 will be handled by a crimping, staking tool or other similar tool. The necks 85, 87 are of sufficient lengths such that the deflection of sleeve 81 into the grooves 89, 91 may be performed with the end cap 69 and valve seat member 75 at various axial distances apart from each other. In the embodiment shown, sleeve 81 is shown abutting a shoulder at the base of valve seat member neck 87, while the opposite end of sleeve 81 is shown spaced by a clearance from the shoulder at the base of end cap neck 85. Axial adjustment of the distance between end cap 69 and valve seat member 75 may be made on either of the necks 85, 87, or on both.

A bellows 93 locates within sleeve 81. Bellows 93 has one end portion that locates in a recess 95 formed in end cap 69. A stem 97 protrudes from the opposite end. Bellows 93 is initially evacuated prior to assembly.

Stem 97 inserts into an axially extending seat passage in valve seat member 75, which has a smaller diameter portion 99*a* and a larger diameter portion 99*b*. A valve element, shown to be a ball 101, is carried in seat passage portion 99*b* for contact by stem 97. The different diameters of seat passage portions 99*a*, 99*b* result in a shoulder or seat 103. Ball 101 will engage seat 103 to close seat passage portion 99*a* from communication with seat passage portion 99*b*. A coil spring 105 urges ball 101 against the seat 103. Spring 105 is supported by a bushing 107 that is inserted into the lower end of valve seat member 75.

Bushing 107 also carries a bias pin 109 slidingly within a discharge pressure port 111. Discharge pressure port 111 is coaxial with seat passage portions 99*a*, 99*b*. Bias pin 109 has one end that will contact ball 101. The opposite end is exposed to discharge pressure in discharge pressure portion 63*c* of cavity 63.

A control pressure port 113 extends through valve seat member 75 from seat passage 99*b* to the exterior of valve seat member 75 in communication with cavity control pressure portion 63*b*. Control pressure port 113 thus communicates directly with control pressure passage 67. A metered orifice 115 extends through valve seat member 75 from its end adjacent cavity base 63*d* to control pressure port 113. Metered orifice 115 is a smaller diameter passage, preferably about 0.8 mm, that continuously communicates cavity discharge pressure portion 63*c* with cavity control pressure portion 63*b*. In the embodiment shown, metered orifice 115 extends along an axis that is parallel with the axis of seat passage portions 99*a*, 99*b*.

During assembly of compressor 11, control valve 62 will be assembled as a modular assembly, except that sleeve 81 will still remain slidable relative to at least one of the necks 85, 87. Once assembled, the operator will place the control valve 62 in a test fixture. In the test fixture, pressures can be applied to simulate the actual operation when assembled in a compressor 11. The test fixture is not shown, but similar to an actual compressor, it will have a cavity with a suction pressure portion, a control pressure portion, and a discharge pressure portion similar to cavity portions 63*a, b, c*. Based on predetermined specifications, the operator will apply and monitor pressures to control valve 62 to determine the proper distance that end cap 69 should be from valve seat member 75. For example, the operator may apply a suction pressure and a discharge pressure to control valve 62, then monitor the control pressure. The operator would then move the valve seat member 75 and end cap 69 toward or away from each other depending upon the monitored control pressure.

At the desired point depending upon the pressure differential between the suction and intake pressures, the stem 97 should push ball 101 off of seat 103. This results in a different pressure at control pressure port 113. The operator would then complete the staking operation, by either staking sleeve 81 to groove 89 or to groove 91. Normally, one of the ends of sleeve 81 would already be staked to one of the grooves 89, 91. The staking operation may be accomplished in the fixture if the fixture is so designed. Alternately, the operator may be able to remove the control valve 62 for completing the staking operation. The suction pressure set point adjustment adjusts the control valve 62 for variances in different bellows 93.

Figure 4:
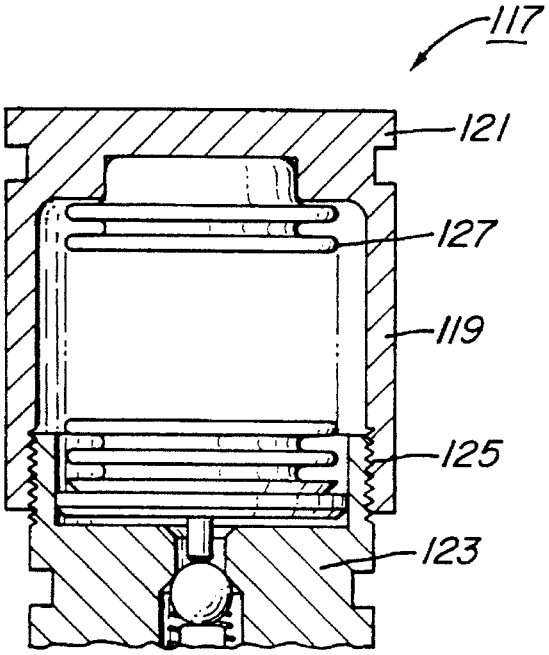
FIG. 4 is a sectional view of portions of an alternate embodiment of a control valve for the compressor of FIG. 1.

FIG. 4 shows portions of an alternate embodiment of control valve 117, which has portions not shown that are the same as control valve 62 of FIG. 3. In FIG. 4, rather than utilizing a staking operation on sleeve 81, sleeve 119 is integrally joined to end cap 121. Valve seat member 123 and sleeve 119 secure to each other by mating threads 125. Bellows 127 is located within sleeve 119. Rotating valve seat member 123 relative to sleeve 119 changes the axial distance from end cap 121 to valve seat member 123. This allows the suction pressure set point to be adjusted for bellows 127 in the same manner as previously described.

In operation, at startup, the actuator piston 39 will be located in the position shown in FIG. 2. Rotary valve plate 25 will be in the minimum delivery position. Referring to FIGS. 3 and 4, initially the bellows 93 will be contracted and the force of discharge pressure on the end of bias pin 109 plus the force of spring 105 on ball 101 will keep ball 101 closed. Discharge pressure from passage 65 is applied to bias pin 109 and also flows through metered orifice 115 into control pressure passage 67 to the control pressure side 41*b* of actuator piston chamber 41. This causes piston 41 to move to the right from the position shown in FIG. 2, rotating rotary valve plate 25. This increases the capacity of compressor 11 by changing the timing of the compression cycle and increasing the volume of refrigerant being compressed. At the same time, discharge pressure is applied through control pressure passage 67 to seal ring 57, which applies an axial force to rotary valve plate 25. This causes rotary valve plate 25 to more tightly bear against compression housing shoulder 31. Consequently, at high pressures within compression chamber 15, a high axial force proportional to the discharge pressure is applied against the rotary valve plate 25 to enhance sealing with compression housing shoulder 31.

At highway speeds and at cooler conditions, the demand will decrease on compressor 11. The discharge pressure and the suction pressure in suction chamber 37 will decrease. The lower suction pressure causes bellows 93 to expand.

When the force due to the expansion of bellows 93 exceeds the force due to spring 105 plus the force due to discharge pressure acting on bias pin 109, stem 97 will push ball 101 off of its seat 103. This exposes control pressure passage 67 to pressure in suction chamber 37. This reduces the pressure in control passage 67, decreasing the force on actuator piston 39, causing it to move to the left to rotate valve plate 25, reducing the capacity of compressor 11.

At the same time, the lower pressure in control pressure passage 67 reduces pressure on seal ring 57, lowering the axial force on rotary valve plate 25. This allows rotary valve plate 25 to more freely rotate back to a lesser capacity position. Consequently, the axial force in rotary valve plate 25 varies in proportion to the control pressure applied to actuator piston 39.

This invention has significant advantages. The modular control valve can be adjusted for suction pressure set point prior to installation in a compressor. This avoids additional expense of adjusting the assembled compressor with a nitrogen pressure test operation. The modular control valve avoids the need for drilling a metered orifice through the rotary valve housing by placing the orifice in a portion of the modular control valve.

While the invention has been shown in only two of its forms, it should be apparent to those skilled in the art that it is not so limited, but is susceptible to various changes without departing from the scope of the invention.

We claim:

1. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member, an orifice communicating pressure from the discharge chamber to the actuator member for rotating the valve plate, and control valve means for changing the pressure applied to the actuator through the orifice, the control valve means comprising:

a cavity formed in the housing, the cavity having an axis, a suction pressure portion and a control pressure portion spaced axially from the suction pressure portion;

the suction pressure portion being in communication with the intake chamber;

a control pressure passage communicating the control pressure portion of the cavity with the actuator member;

a modular control valve assembly located in the cavity, comprising:

an end cap;

a valve seat member positioned opposite the end cap, having a valve seat, a valve element which movably engages the seat;

the valve seat member having a control pressure port leading from the valve seat to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion from the control pressure portion; and adjustment means for varying the distance between the end cap and valve seat member during assembly of the modular control valve to allow a suction pressure set point adjustment to be made for the bellows prior to positioning the modular control valve in the cavity.

2. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member, an orifice communicating pressure from the discharge chamber to the actuator member for rotating the valve plate, and control valve means for changing the pressure applied to the actuator through the orifice, the control valve means comprising:

a cavity formed in the housing, the cavity having an axis, a suction pressure portion and a control pressure portion spaced axially from the suction pressure portion;

the suction pressure portion being in communication with the intake chamber;

a control pressure passage communicating the control pressure portion of the cavity with the actuator member;

a modular control valve assembly located in the cavity, comprising:

an end cap;

a valve seat member positioned opposite the end cap, having a valve seat, a valve element which movably engages the seat;

the valve seat member having a control pressure port leading from the valve seat to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion from the control pressure portion;

wherein at least one of the end cap and the valve seat member has a neck over which one end of the sleeve slidingly inserts; and connection means for connecting the sleeve to the neck at variable axial positions for varying the distance between the end cap and valve seat member, to allow a suction pressure set point adjustment to be made for the bellows prior to positioning the modular control valve in the cavity.

3. The compressor according to claim 2, wherein the connection means comprises:

an annular groove formed in the neck, the sleeve being sufficiently thin to allow a portion of the sleeve to be permanently deflected into the groove to secure the sleeve to the neck.

4. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member, an orifice communicating pressure from the discharge chamber to the actuator member for rotating the valve plate, and control valve means for changing the pressure applied to the actuator through the orifice, the control valve means comprising:

a cavity formed in the housing, the cavity having an axis, a suction pressure portion and a control pressure portion spaced axially from the suction pressure portion;

the suction pressure portion being in communication with the intake chamber;

a control pressure passage communicating the control pressure portion of the cavity with the actuator member;

a modular control valve assembly located in the cavity, comprising:

an end cap;

a valve seat member positioned opposite the end cap, having a valve seat, a valve element which movably engages the seat;

the valve seat member having a control pressure port leading from the valve seat to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion from the control pressure portion; and wherein at least one of the end cap and the valve seat member has a threaded neck, and wherein the sleeve has a threaded end which engages the threaded neck, the threaded end and threaded neck allowing an axial distance between the end cap and the valve seat member to be varied during assembly of the modular control valve.

5. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member, an orifice communicating pressure from the discharge chamber to the actuator member for rotating the valve plate, and control valve means for changing the pressure applied to the actuator through the orifice, the control valve means comprising:

a cavity formed in the housing, the cavity having an axis, a suction pressure portion and a control pressure portion spaced axially from the suction pressure portion;

the suction pressure portion being in communication with the intake chamber;

a control pressure passage communicating the control pressure portion of the cavity with the actuator member;

a modular control valve assembly located in the cavity, comprising:

an end cap;

a valve seat member positioned opposite the end cap, having a valve seat, a valve element which movably engages the seat;

the valve seat member having a control pressure port leading from the valve seat to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion from the control pressure portion; and wherein the control pressure portion has a smaller diameter than the suction pressure portion.

6. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member for rotating the valve plate, and control valve means for supplying a variable control pressure to the actuator member for moving the actuator member and valve plate in response to varying pressures in the intake chamber and discharge chamber, the control valve means comprising:

a cavity formed in the housing, the cavity having an axis, a suction pressure portion, a discharge pressure portion spaced axially from the suction pressure portion, and a control pressure portion located between the discharge pressure portion and the suction pressure portion;

the suction pressure portion being in communication with the intake chamber;

a discharge pressure passage communicating the discharge pressure portion with the discharge chamber;

a control pressure passage communicating the control pressure portion of the cavity with the actuator member;

a modular control valve assembly located in the cavity, comprising.:

an end cap;

a valve seat member positioned opposite the end cap, having a valve seat, a valve element which movably engages the seat and which is urged by discharge pressure in the discharge pressure portion of the cavity into engagement with the seat;

the valve seat member having a control pressure port leading from the valve seat to the control pressure portion of the cavity;

the valve seat member having an orifice leading from the discharge portion of the cavity to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion, the control pressure portion, and the discharge pressure portion from each other, so that when suction pressure is above a selected point, the valve element will be closed and discharge pressure will be applied through the orifice and control pressure passage to the actuator, and when suction pressure decreases sufficiently for expansion of the bellows to overcome a force on the valve element caused by discharge pressure, the bellows will move the valve element from the valve seat, allowing pressure on the actuator to reduce through the control pressure passage, control pressure port, valve seat, suction port, and suction pressure portion of the cavity; and adjustment means for varying the distance between the end cap and valve seat member to allow a suction pressure set point adjustment to be made for the bellows prior to positioning the modular control valve in the cavity.

7. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member for rotating the valve plate, and control valve means for supplying a variable control pressure to the actuator member for moving the actuator member and valve plate in response to varying pressures in the intake chamber and discharge chamber, the control valve means comprising:

a cavity formed in the housing, the cavity having an axis, a suction pressure portion, a discharge pressure portion spaced axially from the suction pressure portion, and a control pressure portion located between the discharge pressure portion and the suction pressure portion;

the suction pressure portion being in communication with the intake chamber;

a discharge pressure passage communicating the discharge pressure portion with the discharge chamber;

a control pressure passage communicating the control pressure portion of the cavity with the actuator member;

a modular control valve assembly located in the cavity, comprising:

an end cap;

a valve seat member positioned opposite the end cap, having a valve seat, a valve element which movably engages the seat and which is urged by discharge pressure in the discharge pressure portion of the cavity into engagement with the seat;

the valve seat member having a control pressure port leading from the valve seat to the control pressure portion of the cavity;

the valve seat member having an orifice leading from the discharge portion of the cavity to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion, the control pressure portion, and the discharge pressure portion from each other, so that when suction pressure is above a selected point, the valve element will be closed and discharge pressure will be applied through the orifice and control pressure passage to the actuator, and when suction pressure decreases sufficiently for expansion of the bellows to overcome a force on the valve element caused by discharge pressure, the bellows will move the valve element from the valve seat, allowing pressure on the actuator to reduce through the control pressure passage, control pressure port, valve seat, suction port, and suction pressure portion of the cavity;

wherein at least one of the end cap and the valve seat member has a neck over which one end of the sleeve slidingly inserts; and connection means for connecting the sleeve to the neck at variable axial positions for varying the distance between the end cap and valve seat member to allow a suction pressure set point adjustment to be made for the bellows prior to positioning the modular control valve in the cavity.

8. The compressor according to claim 7, wherein the connection means comprises:

an annular groove formed in the neck, the sleeve being sufficiently thin to allow a portion of the sleeve to be permanently deflected into the groove to secure the sleeve to the neck.

9. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member for rotating the valve plate, and control valve means for supplying a variable control pressure to the actuator member for moving the actuator member and valve plate in response to varying pressures in the intake chamber and discharge chamber, the control valve means comprising:

a cavity formed in the housing, the cavity having an axis, a suction pressure portion, a discharge pressure portion spaced axially from the suction pressure portion, and a control pressure portion located between the discharge pressure portion and the suction pressure portion;

the suction pressure portion being in communication with the intake chamber;

a discharge pressure passage communicating the discharge pressure portion with the discharge chamber;

a control pressure passage communicating the control pressure portion of the cavity with the actuator member;

a modular control valve assembly located in the cavity, comprising:

an end cap;

a valve seat member positioned opposite the end cap, having a valve seat, a valve element which movably engages the seat and which is urged by discharge pressure in the discharge pressure portion of the cavity into engagement with the seat;

the valve seat member having a control pressure port leading from the valve seat to the control pressure portion of the cavity;

the valve seat member having an orifice leading from the discharge portion of the cavity to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion, the control pressure portion, and the discharge pressure portion from each other, so that when suction pressure is above a selected point, the valve element will be closed and discharge pressure will be applied through the orifice and control pressure passage to the actuator, and when suction pressure decreases sufficiently for expansion of the bellows to overcome a force on the valve element caused by discharge pressure, the bellows will move the valve element from the valve seat, allowing pressure on the actuator to reduce through the control pressure passage, control pressure port, valve seat, suction port, and suction pressure portion of the cavity; and wherein at least one of the end cap and the valve seat member has a threaded neck, and wherein the sleeve has a threaded end which engages the threaded neck, the threaded end and threaded neck allowing an axial distance between the end cap and the valve seat member to be varied.

10. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member for rotating the valve plate, and control valve means for supplying a variable control pressure to the actuator member for moving the actuator member and valve plate in response to varying pressures in the intake chamber and discharge chamber, the control valve means comprising:

a cavity formed in the housing, the cavity having an axis, a suction pressure portion, a discharge pressure portion spaced axially from the suction pressure portion, and a control pressure portion located between the discharge pressure portion and the suction pressure portion;

the suction pressure portion being in communication with the intake chamber;

a discharge pressure passage communicating the discharge pressure portion with the discharge chamber;

a control pressure passage communicating the control pressure portion of the cavity with the actuator member;

a modular control valve assembly located in the cavity, comprising;

an end cap;

a valve seat member positioned opposite the end cap, having a valve seat, a valve element which movably engages the seat and which is urged by discharge pressure in the discharge pressure portion of the cavity into engagement with the seat;

the valve seat member having a control pressure port leading from the valve seat to the control pressure portion of the cavity;

the valve seat member having an orifice leading from the discharge portion of the cavity to the control pressure portion of the cavity;

a bellows having one end in contact with the end cap, and on an opposite end a stem located on the cavity axis which engages the valve element;

a sleeve extending between the end cap and valve seat member, enclosing the bellows, the sleeve having a suction port exposing the exterior of the bellows to the suction pressure portion of the cavity;

seal means on the modular control valve assembly for sealingly separating the suction pressure portion, the control pressure portion, and the discharge pressure portion from each other, so that when suction pressure is above a selected point, the valve element will be closed and discharge pressure will be applied through the orifice and control pressure passage to the actuator, and when suction pressure decreases sufficiently for expansion of the bellows to overcome a force on the valve element caused by discharge pressure, the bellows will move the valve element from the valve seat, allowing pressure on the actuator to reduce through the control pressure passage, control pressure port, valve seat, suction port, and suction pressure portion of the cavity; and wherein the discharge pressure portion has a smaller diameter than the control pressure portion, and the control pressure portion has a smaller diameter than the suction pressure portion.

11. In a compressor having a housing containing a compression chamber, an intake chamber on one end of the compression chamber and a discharge chamber on the other end of the compression chamber, a rotatably driven rotor having a plurality of radial vanes and extending axially through the compression chamber, a rotary valve plate rotatably carried in the intake chamber and configured to vary the position of an opening from the intake chamber to the compression chamber, an actuator member for rotating the valve plate, and control valve means for supplying a variable control pressure to the actuator member for moving the actuator member and valve plate in response to varying pressures in the intake chamber and discharge chamber, the control valve means comprising:

a cavity formed in the housing, the cavity having an axis, a suction pressure portion, a discharge pressure portion spaced axially from the suction pressure portion, and a control pressure portion located between the discharge pressure portion and the suction pressure portion;

the suction pressure portion being in communication with the intake chamber;

a discharge pressure passage communicating the discharge pressure portion with the discharge chamber;

a control pressure passage communicating the control pressure portion of the cavity with the actuator member;

a modular control valve assembly located in the cavity, comprising:

an end cap;

a valve seat member positioned opposite the end cap, having a valve seat, a valve element which movably engages the seat, a spring which urges the valve element into engagement with the seat, and a bias pin movably carried in a discharge pressure port in the valve seat member on the cavity axis and having a first end engaging the valve element on the same side as the spring, the discharge pressure port exposing a second end of the bias pin to the discharge pressure portion of the cavity;

the valve seat member having a control pressure port leading from the valve seat to the control pressure portion of the cavity;

the valve seat member having an orifice leading from the discharge portion of the cavity to the control pressure portion of the cavity;

a bellows having one end in contact with the end cap, and on an opposite end a stem located on the cavity axis which engages the valve element opposite the spring and bias pin;

a sleeve extending between the end cap and valve seat member, enclosing the bellows, the sleeve having a suction port exposing the exterior of the bellows to the suction pressure portion of the cavity;

connection means for connecting the sleeve between the end cap and the valve seat member with the end cap and the valve seat member being at variable axial distances from each other during assembly of the modular control valve; and seal means on the modular control valve assembly for sealingly separating the suction pressure portion, the control pressure portion, and the discharge pressure portion from each other, so that when suction pressure is above a selected point, the valve element will be closed and discharge pressure will be applied through the orifice and control pressure passage to the actuator, and when suction pressure decreases sufficiently for expansion of the bellows to overcome a force on the valve element caused by the spring plus discharge pressure acting on the bias pin, the stem of the bellows will move the valve element from the valve seat, allowing pressure on the actuator to reduce through the control pressure passage, control pressure port, valve seat, suction port, and suction pressure portion of the cavity.

12. The compressor according to claim 11 wherein the connection means comprises:

a neck on a selected one of the end cap and the valve seat member, the sleeve being slidable over the neck and securable at variable points on the sleeve.

13. The compressor according to claim 11 wherein the connection means comprises:

a neck on a selected one of the end cap and the valve seat member, the sleeve being slidable over the neck; and an annular groove formed in the neck, the sleeve being sufficiently thin to allow a portion of the sleeve to be permanently deflected into the groove to secure the sleeve to the neck at variable positions along the sleeve.

14. The compressor according to claim 11 wherein the connection means comprises:

a threaded neck on a selected one of the end cap and the valve seat member;

a threaded end on the sleeve which engages the threaded neck, the threaded end and threaded neck allowing an axial distance between the end cap and the valve seat member to be varied.

15. The compressor according to claim 11 wherein the discharge pressure portion has a smaller diameter than the control pressure portion, and the control pressure portion has a smaller diameter than the suction pressure portion.

16. A method of installing a control valve for a compressor, the compressor having a housing containing a compression chamber, an intake chamber on one end of the compression chamber and a discharge chamber on the other end of the compression chamber, a rotary valve plate rotatably carried in the intake chamber and configured to vary the position of an opening from the intake chamber to the compression chamber, and an actuator member for rotating the valve plate, comprising the steps of:

forming a cavity in the housing, the cavity having an axis, a suction pressure portion which communicates with the intake chamber, a discharge pressure portion spaced axially from the suction pressure portion and which communicates with the discharge chamber, and a control pressure portion located between the discharge pressure portion and the suction pressure portion and which communicates the control pressure portion of the cavity with the actuator member;

providing a modular control valve assembly, comprising:

an end cap;

a valve seat member positioned opposite the end cap, having a control pressure port, an orifice, a valve seat, a valve element which movably engages the seat, and a discharge pressure port for applying a force to the valve element resulting from discharge pressure;

a bellows having one end in contact with the end cap, and on an opposite end a stem located on the cavity axis which engages the valve element; and a sleeve extending between the end cap and valve seat member, enclosing the bellows, the sleeve having a suction port exposing the exterior of the bellows to the suction pressure portion of the cavity; then prior to installing the modular control valve assembly in the cavity, applying and monitoring pressures at the suction port, control passage and discharge pressure port at preselected levels; then varying the axial distance between the end cap and the valve seat member until expansion of the bellows causes the stem to overcome a force exerted by the discharge pressure on the valve element, moving the valve element from the valve seat; then securing the sleeve, end cap, and valve seat member to each other at the desired axial distance when the valve element moved from the valve seat; then inserting the modular control valve assembly into the cavity, with the discharge pressure port in the discharge pressure portion, the control port in the control pressure portion, and the suction port in the suction pressure portion, and sealing the discharge pressure portion, control pressure portion and suction pressure portion from each other.

17. The method according to claim 16, wherein the steps of varying the axial distance between the end cap and valve seat member and securing the sleeve, end cap, and valve seat member to each other comprise:

providing a neck on at least one of the end cap and the valve seat member;

slidingly inserting one end of the sleeve over the neck until the desired axial distance has been determined; then securing the sleeve to the neck.

18. The method according to claim 16, wherein the steps of varying the axial distance between the end cap and valve seat member and securing the sleeve, end cap, and valve seat member to each other comprise:

providing a neck on at least one of the end cap and the valve seat member and providing the neck with an annular groove;

slidingly inserting one end of the sleeve over the neck until the desired axial distance has been determined; then deflecting a portion of the sleeve into the groove to secure the sleeve to the neck.

19. The method according to claim 16, wherein the steps of varying the axial distance between the end cap and valve seat member and securing the sleeve, end cap, and valve seat member to each other comprise:

providing a threaded neck on at least one of the end cap and the valve seat member;

providing threads on one end of the sleeve and rotating the threads of the sleeve on the threaded neck until the desired axial distance has been determined.

* * * * *